US008486326B2

(12) United States Patent
Isidorov

(10) Patent No.: US 8,486,326 B2
(45) Date of Patent: Jul. 16, 2013

(54) METHOD AND DEVICE FOR INDUCTION STIRRING OF MOLTEN METAL

(75) Inventor: Eduard Isidorov, Riga (LV)

(73) Assignee: SIA 'GORS', Riga (LV)

( * ) Notice: Subject to any disclaimer, the term of this patent is extended or adjusted under 35 U.S.C. 154(b) by 838 days.

(21) Appl. No.: 12/297,535

(22) PCT Filed: Apr. 5, 2007

(86) PCT No.: PCT/LV2007/000001

§ 371 (c)(1),
(2), (4) Date: Oct. 17, 2008

(87) PCT Pub. No.: WO2007/120028

PCT Pub. Date: Oct. 25, 2007

(65) Prior Publication Data

US 2009/0129197 A1 May 21, 2009

(30) Foreign Application Priority Data

Apr. 19, 2006 (LV) ..... P 06 59

(51) Int. Cl.
*C22B 1/16* (2006.01)

(52) U.S. Cl.
USPC ..... 266/234

(58) Field of Classification Search
USPC ..... 266/234
See application file for complete search history.

(56) References Cited

U.S. PATENT DOCUMENTS

| | | | | |
|---|---|---|---|---|
| 3,591,698 | A * | 7/1971 | Howard et al. | 266/234 |
| 5,354,970 | A * | 10/1994 | Knupfer | 219/609 |
| 2004/0135297 | A1 * | 7/2004 | Houghton | 266/234 |
| 2005/0035503 | A1 | 2/2005 | Peel et al. | |

FOREIGN PATENT DOCUMENTS

| | | | |
|---|---|---|---|
| GB | 2 389 645 | A | 12/2003 |
| RU | 2 130 359 | C1 | 5/1999 |
| SU | 532459 | A | 1/1977 |
| SU | 1630868 | A1 | 2/1991 |

OTHER PUBLICATIONS

International Preliminary Report of Patentability as issued in Latvia International Application No. PCT/LV2007/000001, filed Apr. 5, 2007.

Written Opinion dated Aug. 2, 2007, as issued in Latvia International Application No. PCT/LV2007/000001, filed Apr. 5, 2007.

* cited by examiner

*Primary Examiner* — Scott Kastler
(74) *Attorney, Agent, or Firm* — Sughrue Mion, PLLC

(57) ABSTRACT

The invention relates to a method and device for the induction stirring of liquid metal in the bath of a reverberatory furnace by using a traveling magnetic field whose frequency ranges from 50 to 60 Hz. The device is in the form of a module and comprises an inductor of a running magnetic field and an unit, wherein the unit has a channel in the form of a chamber and the inductor is located horizontally under the chamber.

8 Claims, 3 Drawing Sheets

METHOD AND DEVICE FOR INDUCTION STIRRING OF MOLTEN METAL

CROSS REFERENCE TO RELATED APPLICATIONS

This application is a National Stage of International Application No. PCT/LV2007/000001, filed Apr. 5, 2007, claiming priority based on Latvian Patent Application No. P-06-59, filed Apr. 19, 2006, the contents of all of which are incorporated herein by reference.

TECHNICAL FIELD

This invention relates to metallurgy. More particularly, this invention is concerned with methods and devices for stirring molten metal (aluminum, its alloys) in a vessel of reverberatory furnaces.

In induction type furnaces, the major part of the capacity of the magnetic field is used for heating, and stirring of the molten metal is an attendant process. This invention is concerned with providing a method and device intended primarily for induction stirring of molten metal.

PRIOR ART

There are known a method and an apparatus [U.S. Pat. No. 5,948,138 Sep. 7, 1999, Issidorov, "Method and apparatus for stirring of molten metal using electromagnetic field", C22B 9/187] for stirring molten metal in the vessel of the furnace by using an electromagnetic field. The inductor of the running magnetic field is positioned along the vertical wall of the furnace. The furnace contains the passageway for molten metal. The incoming stream of molten metal from the passageway into the vessel is directed mainly along a wall of the vessel.

The intensity of the jet-mixing in the middle of the vessel is lower than along the walls thereof. Thus, for melting of solid metal in the middle of the vessel, additional mechanical-contact stirring is required.

Another shortcoming, that limits the use of said method and apparatus, is the necessity of long-term stoppage of the furnace for dismantling of the inductor and for replacement of plates for removal of slag from the passageway.

A furnace [U.S. Pat. No. 4,685,657 Aug. 11, 1987. Kunio Okubo, Ise et al. "Melting Furnace", C22B 9/16] is known with a fixed pocket along an end of the furnace, underneath which the inductor is placed. The bottom of the pocket is located flush with the bottom of the furnace.

Metal pumps along the pocket and comes in the vessel through a window in the wall of the vessel. The intensity of the stirring in the middle of the vessel is lower than on the sides of the vessel.

An invention is known [U.S. Pat. No. 4,355,789 Oct. 26, 1982, Boris Dolzhenkov et al. "Gas pump for stirring molten metal"], the aim of which is to provide an apparatus for stirring that does not require any substantial reconstruction of the melting furnace and which has to secure the effective jet-mixing of the molten metal in the vessel of the melting furnace. Stirring is achieved in the intermittent regime.

The set aim is not reached, because the mass of the molten metal, which may be discarded into the vessel of the furnace in the form of a jet, cannot exceed the capacity of the pipe of the apparatus. Shortcomings of said apparatus are the laboriousness of the removal of slag from the pipe, and the complexity of travel of the pipe of the mechanical drive pump.

The problem of providing an apparatus mounting which does not involve the substantial reconstruction of the furnace, is solved partially according to patent application [Peel et al, "Furnaces and methods of melting", US Patent Application Publication, Pub Nr. US 2005/0035503 A1, Feb. 17, 2005 Int. CL. C21C 5/42].

The stirrer is made in the form of a module, which contains an electromagnetic pump and crucible that are joined with a furnace by pipes. Shortcomings of said apparatus are the necessity for permanent circulation in order to avoid freezing of the molten metal in pipes and the laboriousness of dismantling the whole apparatus for removal of slag.

Substantial shortcomings include the fact that the surface of the molten metal in the funnel, that is made in the course of rotation of the molten metal in the crucible, oxidizes and the oxide film draws in the volume of the molten metal that is pumped over.

As a prototype where aims of an invention achieved are more likely is the patent application [Houghton, "Apparatus for stirring molten metal comprising electromagnetic induction", UK Patent application GB 2 3 89 645 A, 17.12.2003].

A structure of an apparatus comprises a running magnetic field inductor and a channel in the form of a chute in a unit. A unit is built in the wall of a vessel of the furnace. Molten metal circulates under the influence of the running magnetic field of an inductor, which is mounted under the sloping bottom of the chute. Scrap (crushed metal, metal chips) is fed into the chute on the surface of the molten metal that is pumped over and these materials are kneaded into the molten metal. After the reverse of the direction of the running magnetic field, the molten metal rises by the sloped chute and overflows from the furnace into another reservoir.

The shortcomings of such an apparatus are:

- having the level of the molten metal below the upper end of the inductor, and the magnetic field along the upper part of the inductor is not being used for stirring of molten metal;
- intensive stirring, oxidizing and kneading of oxides at the overflow of the molten metal;
- laboriousness, hard work conditions and the necessity for long term stoppage of the furnace while replacing plates at the bottom of the chute over the inductor.

Essence of the Invention

The present invention is aimed at providing a method and apparatus for more effective stirring of the molten metal in the vessel of a reverberatory type furnace under the influence of a running magnetic field of industrial (low) frequency (50 to 60 Hz), wherein the mounting of an apparatus does not require substantial reconstruction of the furnace and repair thereof requires stoppage of the furnace for a minimal duration. The apparatus is intended for use in furnaces for melting of solid metal, such as mixture-furnaces with molten metal for refinement of the molten metal and for preparation of alloys.

Modifications of the apparatus might be used for kneading and melting in the jet of the pumped molten metal of different types of the crushed scrap, as well as for the overflow of molten metal from the furnace.

The aim is reached by means of the nature of the stirring, wherein the molten metal from the upper layer in the vessel of the furnace, being heated by the flame of burners, submerges in the effective area of the running magnetic field and travels in the form of a flat drowned jet along the bottom of the vessel of the furnace at a speed necessary for washing out of the charging of the solid metal on the bottom of the vessel.

In contrast to the known methods the molten metal is influenced by the running magnetic field along the horizontal plane—the bottom of the chamber at a height over the bottom of the vessel from 0.1 H to 0.5 H, where H is a depth of the vessel of the furnace.

A method is implemented with the use of an apparatus, which is realized in the form of a separate module, which contains in its structure an inductor of the running magnetic field and a unit, wherein the channel in the form of a chamber is located, a length of the chamber along the longitudinal axis of the chamber is confined by an end wall of the unit, the inductor is located horizontally under the chamber, and the module is furnished with a means for its travel and mounting on the wall of the vessel of the furnace. The module is assembled for mounting on the furnace.

In the wall of the vessel, a unit-adaptor with a window is mounted, the window having from the outside of the wall a form and dimensions of a chamber of the attached unit. The width of the window in the unit-adaptor increases to the side of the vessel.

The chamber, the bottom of which is located higher than the bottom of the vessel, is filled up with molten metal after the temperature of the molten metal exceeds the melting temperature of the solid metal. Efficacy of the stirring at this stage is higher than at the early stage of the melting, when the level of the molten metal is lower than 0.1 H of the depth of the vessel, and the temperature of the molten metal is equal to that of the crystallization.

The maximum height (0.5 H) is limited by the fact that, with augmentation of the height of the bottom of the chamber over the bottom of the vessel, the height of the column of the molten metal over the bottom of the chamber decreases, which determines the metal static pressure under the influence of which the molten metal flows from the vessel into the chamber. That leads to the reduction of the entry of the molten metal from the vessel into the chamber, increase of the loss of electromagnetic capacity for stirring of the molten metal directly in the chamber and, as a consequence, the reduction of the speed of entry of the jet into the vessel of the furnace.

The pressure of the molten metal on the bottom of the furnace, located over the bottom of the vessel, is lower by $\Delta h=(0.1-0.5)H$ and the peril of leakage of the molten metal through the plates separating the inductor is lower than in the known apparatus as described above.

Jet-mixing is realized in the intermittent regimes. The speed of jet inflow into the vessel over the range from 0.5 to 5.0 m/per second and the mass of the pumped molten metal during one period—from 0.3 to 3.0 G—of the mass of the molten metal in the vessel of the furnace are set up depending on the stage of the manufacturing method.

The refinement of the molten metal in the vessel of the furnace is realized by the purging of the pumped metal by the gas-flux mixture in the chamber of the apparatus. The mixture is purged in the zone where the molten metal changes its stir direction and submerges to the bottom of the chamber.

For melting of the crushed scrap and chips in the jet of the pumped molten metal, the apparatus has a modification, which differs in that the end wall of the chamber is realized with a slope to the side of the wall of the furnace and over the chamber is placed a mechanism of said material feed.

The nature of the movement of the molten metal along the length of the chamber, wherein the substratum of the metal stirs in the opposite direction to the upper layer direction, enables melting of the solid metal in the chamber, characterized in that the jet of the molten metal, which stirs along the surface, washes out the lower part of the crushed solid metal fed into the chamber and the melting of ingots and coarse scrap in the vessel of the furnace. The melting continues at the submerging of the jet with captured pieces of scrap along the bottom of the chamber and afterwards in the vessel of the furnace. The solid material submerges into the molten metal in the chamber under the influence of its own weight (crushed solid scrap iron), but chips and other types of light crushed scrap are melted with the use of mechanical devices, such as, for example, auger.

Having such a method of melting, the loss of metal and soiling thereof with oxides are reduced.

A modification of an apparatus which is intended for realizing of an additional function (overflow of the molten metal) is characterized in that in the end of the wall of the chamber there is a channel adjoining in the lower part to the bottom of the chamber, and in the upper part to the chute for overflow of the molten metal from the vessel of the furnace into the other reservoir. The molten metal under the influence of the running magnetic field, expanding along the bottom to the side of the end wall of the chamber, gathers speed along the bottom of the chamber, ascends the channel and further overflows by the chute into the reservoir outside the vessel of the furnace. In the modification of an apparatus for induction-siphon overflow, the dynamic head of the jet provides for the raise of the molten metal by the channel to a height sufficient for displacement of air from the pipe-siphon over the chamber, and the overflow of the molten metal from the vessel takes place under the influence of the magnetic field and as a result of the use of the siphon effect.

The overflow method described enables one to realize a crushed scrap melting method characterized in that, after the overflow of part of the molten metal, subsequent scrap melting is made in the molten metal remaining in the vessel, the level thereof being minimum before the beginning of the scrap feed and maximum at the end of the feed, and the level is maintained over the optimal range.

BRIEF DESCRIPTION OF DRAWINGS

The invention will be further described based on an example with reference to the drawings attached.

Figure 1:
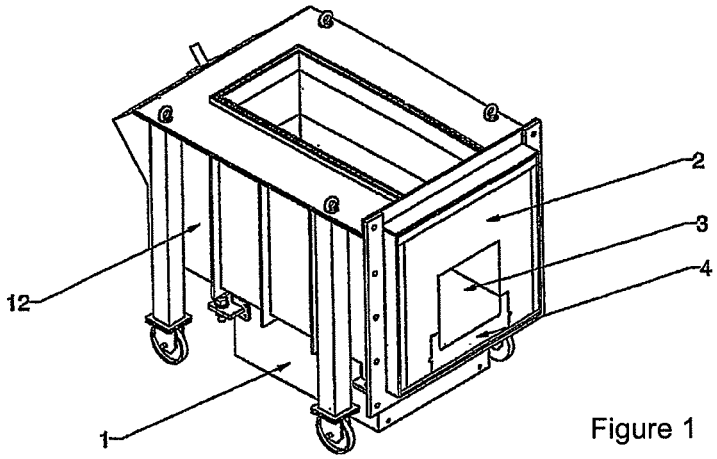
FIG. 1. Module in the assembled form.
Figure 4:
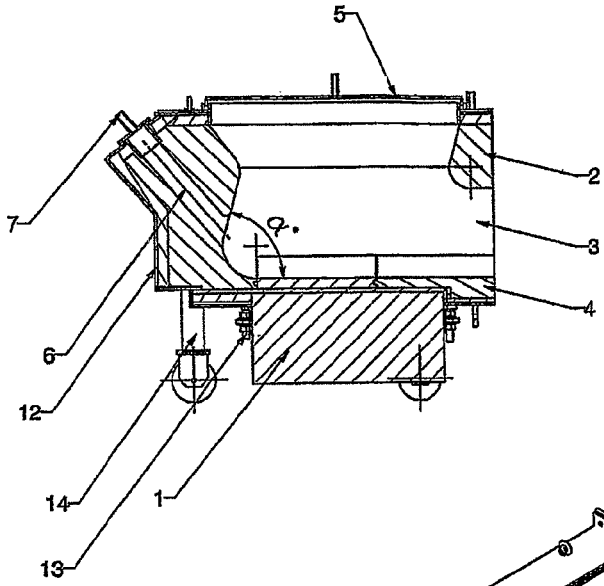
FIG. 4. The module (modified with a refinement chamber), longitudinal slit.
Figure 5:
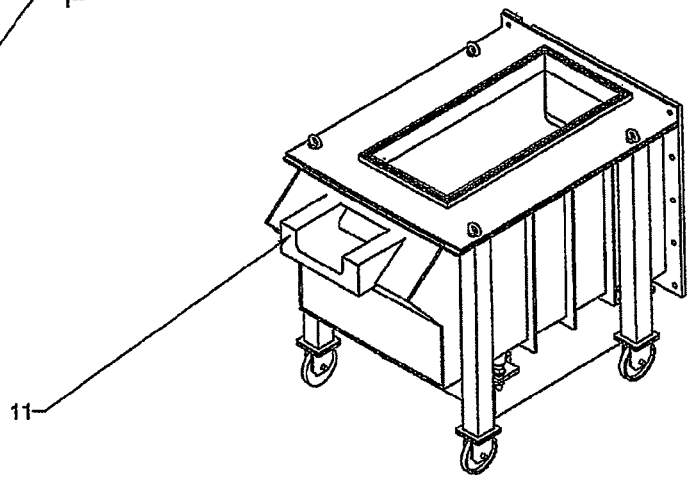
FIG. 5. The module (modified for kneading chips, overflow of the molten metal).

The module (FIGS. 1, 4, 5) comprises in its structure the inductor (1) of the running magnetic field and the rectangular unit (2) of a concrete, along which there is a chamber (3). The bottom of the chamber (3) between the longitudinal walls of the unit is overlapped with plates (4), and over the chamber (3) the lid (5) is mounted. In the end of the chamber (3) there is a sloping aperture (6), whereto the pipe (7) for the gas-flux mixture feed is attached. The incline of the end wall to the bottom of the chamber is $\alpha=60\text{-}80°$.

Figure 6:
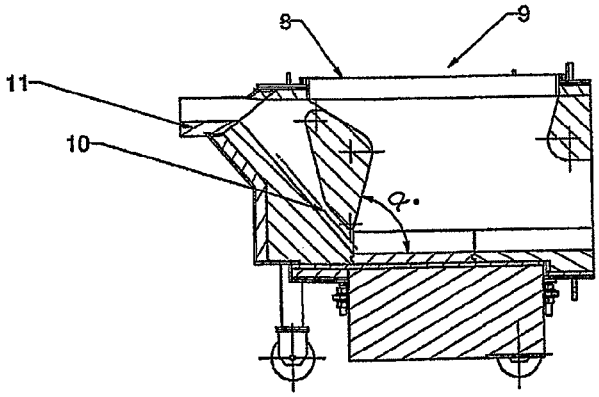
FIG. 6. The module (modified for kneading chips, overflow of the molten metal), longitudinal slit.
Figure 7:
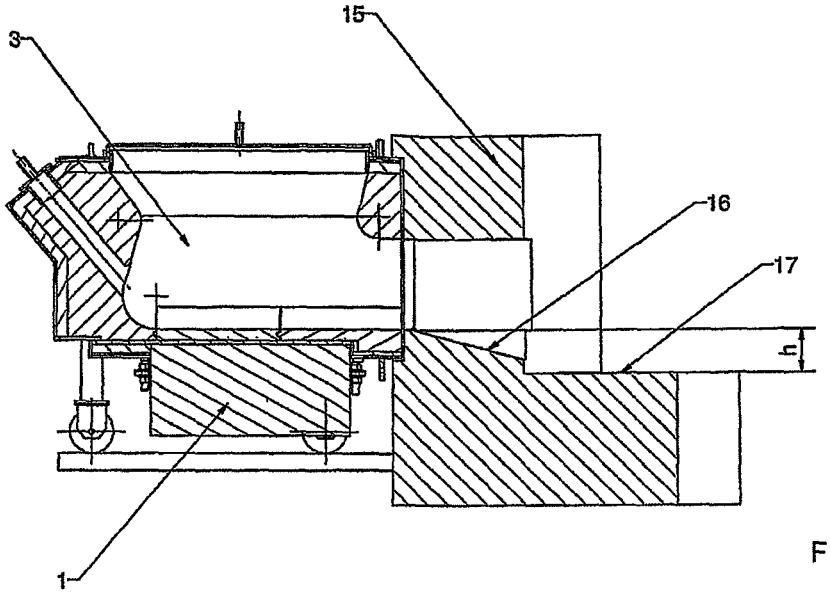
FIG. 7. The module on the wall of a round furnace, longitudinal slit.

To the lid (8) (FIG. 6), the system (9) of the crushed scrap and chips feed is adjoined. In the end of said chamber is a channel (10) made in the form of a flat trench, the height thereof being within the limits (1.0-2.0)d" (d"—the depth of the penetration of the variable magnetic field into the molten metal). In the upper part of the chamber the chute (11) adjoins the channel.

The unit (2) with a chamber is located in the metallic frame (12).

The inductor (1) and the frame (12) are supplied with clamps (13) for the fixation of the inductor (1) on the frame (12). The frame has supports (14) with wheels and weight capturing facilities for the uplifting and travel of the module.

Figure 2:
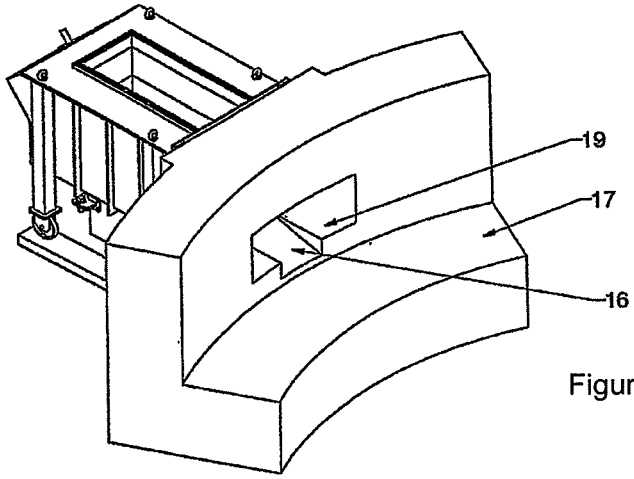
FIG. 2. General view of the module on the wall of a round furnace.
Figure 8:
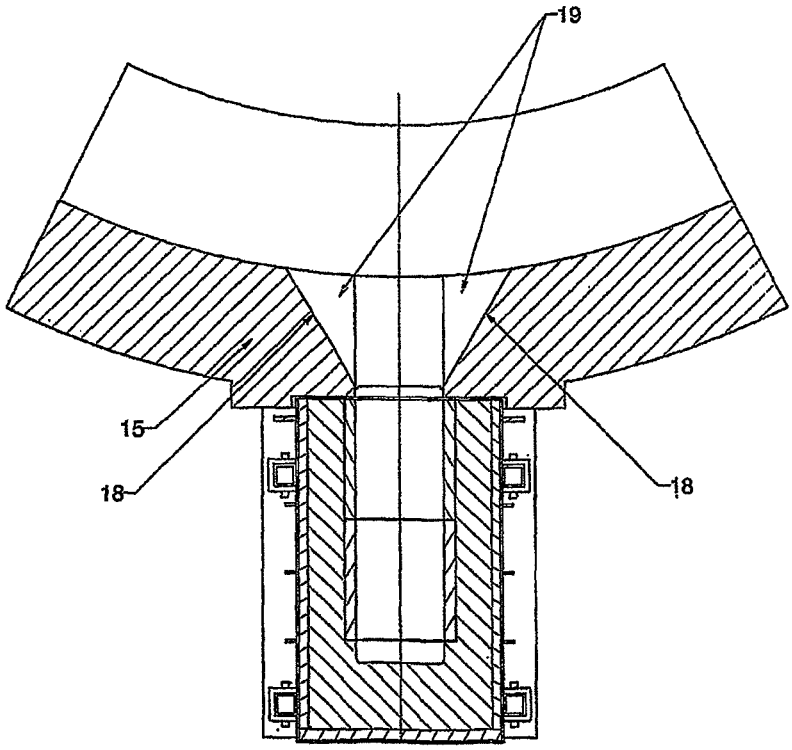
FIG. 8. The module on the wall of a round furnace, horizontal slit.

The module is mounted on the wall of the vessel of the furnace. The depth of the vessel is represented by H. The longitudinal axis of the module (FIGS. 2, 8) goes through the center of the round furnace. In the wall of the vessel there is a unit-adaptor (15) with a window, the dimensions and profile thereof from the outside of the wall are identical with the chamber (3) in the attached module. The bottom (16) of the window in the unit (15) has an inclination to the side of the bottom (17) of the vessel of the furnace edgewise the chamber (3). Side walls (18) of the window in the unit-adaptor (15) are located at an angle to the longitudinal axis and the window in the adaptor expands to the side of the vessel, and the bottom (19) of the window sections expanding in the unit along the side walls (18) is located at the level of the bottom of the chamber (3).

Figure 3:
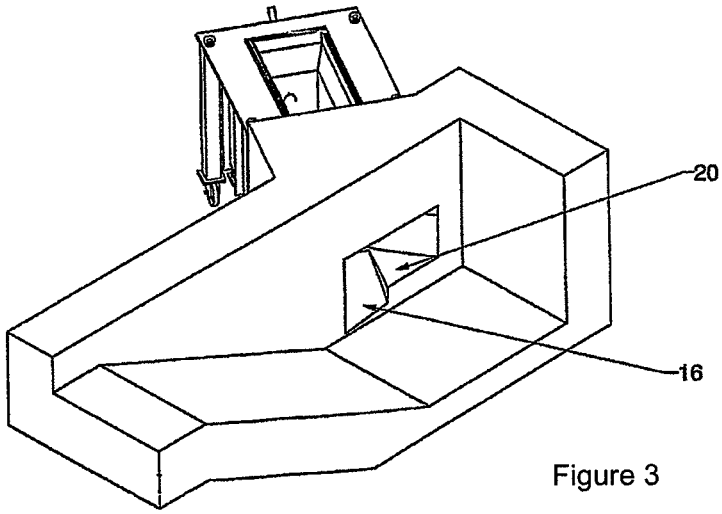
FIG. 3. General view of the module on the wall of a rectangular furnace.

At mounting the module on the wall of the rectangular furnace (FIG. 3), the window in the unit expands from the side of the vessel to one of the sides and this section of the window (20) has in the view on the plan a form of a triangle.

DESCRIPTION OF WORK

The module is assembled to be mounted on the furnace. The unit-adaptor is mounted in the aperture in the wall of the vessel of the furnace. On the surface of the unit-adaptor in the wall of the vessel, gaskets from the resilient heat-resistant material are stuck and the module is pressed to the unit-adaptor.

Solid metal (ingots, scrap) is fed to the bottom of the vessel, and afterwards, is heated and melted under the influence of the flame of burners of the furnace. At the initial stage of melting, the temperature of the molten metal flowing to the bottom of the vessel is equal with the temperature of crystallization. The stirring is at the level below 0.1 H and accordingly, under the low level of heat content in the molten metal, is ineffective.

The chamber (3) of the module, the bottom of which is located over the bottom of the vessel at h=(0.1-0.5)H, is filled at a later stage of melting. The stirring begins (first stage) after the raising of the level of the molten metal over the bottom of the chamber. The molten metal from the chamber (3) under the influence of the running magnetic field induced by the inductor (1), located under the bottom of the chamber, returns to the vessel of the furnace.

At this stage, the temperature of the upper layer of the molten metal exceeds the temperature of the melting of the solid metal and the stirring gives a possibility to provide for the heating and the backwashing of the chamber by the incoming molten metal from the vessel. The stirring regime: the speed of the jet at the entrance into the vessel and the duration of the stirring are minimum.

The molten metal from the upper layer in the vessel flows into the chamber (3) to take place of the pumped metal. The molten metal moves across the depth of the chamber (3) to opposite directions and with different speeds.

In the effective area of the running magnetic field that spreads along the inductor at a speed of 30-60 m/per second, the speed of the flat jet stirring along the bottom of the chamber (3) is maximum and lowers rapidly as the flat jet moves off the bottom of the chamber. The thickness (b) of the pumped layer—flat jet is determined by the depth (d) of the penetration of the variable magnetic field (50 to 60 Hz) into the molten metal and the ductility of the molten metal. The maximum thickness of the layer (b) is within the limits of b=3d. The gradient of stirring speeds along the height of the chamber (3) leads to the origination in the chamber (3) of the pressure gradient and, as a result, to the vertical circulation of the molten metal. The metal from the upper layer, having higher temperature and consequently being lighter than at the bottom, is drawn into the low pressure zone at the bottom of the chamber (3) and returns to the vessel of the furnace in the form of the drowned jet. When stirring along the sloping bottom of the window in the unit-adaptor (15), the jet submerges owing to "the adhesion effect to the solid surface" and further spreads along the bottom of the vessel of the furnace.

In the round type furnace, the jet of the molten metal goes through the center of the vessel with a maximum speed, which is provided by the apparatus, and washes out the base of the charging of the solid metal on the bottom. In the vessel of the furnace two circular contours are formed being directed towards each other, the molten metal thereof is blended in the window in the unit-adaptor (15) and when stirring along the chamber of the apparatus. That part of the molten metal, which flows into the chamber along the side walls (18) over the bottom (19) of sections of the window extending in the unit-adaptor (15), is blended.

In the furnace of the rectangular type of the vessel the module is mounted in such way that its longitudinal axis is at an angle to the wall of the furnace and the jet is directed to the side of the section of the bottom of the vessel which raises to the doorway of the furnace. The molten metal flows from the vessel into the chamber mainly along the wall of the window section extending to the vessel in the unit-adaptor and the molten metal in the vessel, under the influence of the jet and incoming from the chamber, is put in rotatory movement as in the furnace with a round vessel.

The speed of the inflow of the jet of the molten metal into the vessel is regulated by changing the voltage on the winding of the inductor. The adjustment range is (0.5-1.1) Unom (rated voltage). At the voltage lower than 0.5 Unom, the capacity transmitted into the molten metal does not exceed 25% of the rated and the adjustment of the voltage lower than said value is inexpedient. The upper boundary of the voltage is usually limited by performance attributes of the accessory equipment. The speed of the jet might be adjusted by way of changing the frequency of the alternating current and, consequently, of the running magnetic field.

The stirring is made in the intermittent regime, alternating the stirring at a duration of 3-10 minutes, during which from 0.5 G to 3.0 G of the molten metal (where G, t—is the mass of the molten metal in the vessel of the furnace) is pumped over, and pauses at a duration from 3 minutes and on. The stirring in the intermittent regime has advantages compared to continuous stirring, because on the one hand the degree of turbulization of the molten metal in the vessel of the furnace increases, and on the other hand, the duration of the engaging of the inductor decreases at the expense of pauses and consequently the expenditure of the electric power decreases and facilitates the heat regime of the work of the inductor.

Stirring is most intense after the solid metal is fully melted, at the stage of heating the molten metal up to the set temperature, and when treating the molten metal by fluxes.

The minimum intensity (the speed of the jet being not higher than 1.0 m/per second) is at the stage of the washing out at completion of the chamber with the molten metal flowing from the vessel.

The purification of the molten metal from the hydrogen and aluminium oxide is made by purging the pumped molten metal with a gas-flux mixture. The mixture is fed into the molten metal through the sloping aperture in the end of the unit under the pressure necessary for the displacement of the molten metal from the aperture. The gas-flux mixture bubbles through the molten metal. The inert gas with the remainder of the flux fills the volume of the chamber over the molten metal and secures the protection of the surface of the metal being intensively stirred with the floating gas bubbles from the oxidizing.

The stirring of the molten metal at the stage of refinement is made in the continuous regime (without pauses).

In the modification of the apparatus (FIGS. 5, 6) for the melting of the crushed scrap and chips, materials are fed into the chamber through the aperture in the lid (8) over the chamber (3). The crushed material is dragged to the bottom of the chamber by the jet of the molten metal, is transferred to the vessel of the furnace and is melted in the metal being stirred.

After the completion of the melting of the crushed material and raising of the level in the vessel up to the face value, the molten metal melted at this stage is transferred from the melting furnace into another reservoir. For realization of this procedure, the phase sequence of the winding of the inductor is changed—the direction of the spreading of the running magnetic field is reversed.

The molten metal under the influence of a magnetic field, spreading to the side of the end wall of the chamber (3), gathers speed along the bottom of the chamber and ascends the channel (10). Dynamic pressure of the jet, stirring along the bottom of the chamber, ensures the rising of the metal by the channel to a height sufficient for the overflow of the molten metal from the furnace by the chute (11).

The overflow of the molten metal from the furnace might be made as under the influence of the magnetic field only, as in the result of an additional use of the gradient of potential energy from the level difference in between the metal overflow in the chamber and reservoir, whereto the overflow is directed. For realization of this method of overflow in the upper part of the channel attached thereto is the pipe-siphon, which is filled with the molten metal, displacing the air therefrom. The molten metal ascends the channel and begins to overflow by the pipe of the siphon under the influence of the magnetic field.

Further melting of the scrap after the overflow of the part of the molten metal is made in the molten metal remaining in the vessel. After the overflow of the molten metal from the furnace the purification of walls of the chamber from the slag is made. The periodicity of the purification is set by the processing regulations.

For the repair, the module is withdrawn from the furnace. The cooling of the furnace is not required, as it is necessary for repair of an apparatus—prototype. Instead of withdrawing, the backup module might be mounted on the furnace, and the duration of the stoppage of the furnace is reduced to a minimum.

The method of induction jet-mixing intended at increasing the efficacy of the metal melting in the vessel of the furnace is to be explained with the following example.

The description of the method is provided for furnaces of the reverberatory type with a round vessel, supplied with burners for heating and melting of the solid metal being fed onto the bottom of the vessel. The holding capacity of the vessel—the mass of the molten metal 60 t. In the wall of the vessel there is an opening where the unit-adaptor is located. The section of the bottom of the window in the unit-adaptor from the outside of the wall is located at a height of 250 mm over the bottom of the vessel. The depth of the vessel is 900 mm.

The module is mounted on the wall of the furnace and adjoins the window in the wall of the furnace. The bottom of the chamber in the module is located at a height of 250 mm relative to the bottom of the vessel of the furnace. The inductor is located under the bottom of the chamber. The length of the chamber is 1300 mm. The materials for construction of units and plates are concrete CARATH 1400LC AL, and REFRAX RC.

The module is fastened on the frame of the furnace by bolts, and in between the end of the unit and unit-adaptor in the wall of the vessel, there is a gasket made of resilient material (Duraboard, 10 mm).

Power supply: 400V, 50 Hz, 3 phases, capacity 65 kW.

The solid metal (ingots, scrap) is fed onto the bottom of the vessel, the burners are switched on and the metal is heated. The stirring of the molten metal begins after the melting of the part of the metal sufficient for raising the level of the molten metal up to the height of 300-350 mm over the bottom of the vessel of the furnace.

Stirring regime: voltage on the inductor is 280-320V, the duration of stirring/pauses—3/3 minutes. The duration of the cycle is set based on the duration of the raising of the level of the molten metal up to the height of 500-550 mm.

Further stirring regime:—voltage on the inductor is 100% (400 V, engine rated capacity, kW), the duration of stirring/pauses—5/5 minutes, the duration of a cycle—until the full melting of the solid metal. The speed of the flat jet at the entrance into the vessel is 3.0 m/per second. The bulk feed is up to 12 t/per minute.

The duration of stirring/pauses when heating the molten metal up to the set temperature is 6/3 minutes.

A further procedure is elimination of the hydrogen and aluminium oxide, made by the purging of the pumped molten metal with gas-flux mixture. The mixture is fed into the molten metal through the sloping aperture in the end of the unit under a pressure of 0.5-1.0 bar. The duration of the stirring of the molten metal in the continuous regime (without pauses) is 20-30 minutes. The depth of the purification is 40-50% of the initial content of admixtures.

In comparison with the stirring by the apparatus-prototype the speed of melting when using the claimed method and apparatus is increased by 20%, and the fuel depletion and metal loss are decreased by 15% and 25% accordingly.

The purification of walls of the chamber from slag is made with the lid removed after the overflow of the molten metal from the furnace.

The dismantling of the module for changing of the plates is made with a periodicity of 12 months and more.

The method of induction jet-mixing in the furnace for melting of crushed solid scrap and other types of grinded scrap is explained based on the following example.

The module is mounted on the end wall of the vessel of the 30 t furnace of the rectangular form. The longitudinal axis of the module is directed at an angle of 60° relative to the end of the furnace. The depth of the vessel is 750 mm. The bottom of the module is located at the height of 100 mm over the bottom of the furnace. The inductor is mounted under the bottom of the chamber, the length of the inductor is 900 mm, and the length of the chamber is 1300 mm.

To the vessel of the furnace, 12-14 t of the solid scrap is fed, sufficient to fill the vessel with the molten metal up to the height of 300-350 mm. The molten metal is heated up to a temperature of 750-760°. The metal is melted and heated up to the set temperature, ensuring the stirring according to the method described above.

Crushed material begins to be fed into the chamber of the module when the level of the pumped molten metal over the bottom of the chamber is 200-250 mm. The speed of the feed is up to 5 t/per hour. The molten metal is pumped over through the chamber continuously until the end of the material feed. The mass of the melted crushed scrap is 16-18 t. Crushed material submerges into the molten metal and melts under conditions of the intensive stirring of the molten metal in the chamber. The melting of the solid metal in the molten metal ends in the vessel, wherein the metal is stirred by the jet inflowing from the chamber. The bulk feed and speed of the inflow of the jet of the molten metal into the vessel is 10-12 t/per minute and 2.5-3.0 m/per second accordingly.

Crushed chips are fed into the chamber and are melted down into the molten metal by the auger feeder.

The stirring regime upon the end of the solid material feed into the chamber, at the completion of melting of the material in the vessel and heating of the molten metal is intermittent (5/5 minutes).

The overflow of the molten metal from the melting furnace into the furnace-forehearth is made by the channel in the end wall of the chamber. The direction of the pumping of the molten metal is changed to the opposite direction by switching the order of the alternation of phases of the winding of the inductor. The molten metal under the influence of the running magnetic field stirs along the bottom to the end of the chamber, ascends the channel in the wall of the chamber and overflows by the chute into another reservoir. The duration of the overflow is 12-15 minutes.

The overflow is made of such an amount of metal (16-18 t), which enables the melting of the crushed material to proceed in the remaining molten metal in the furnace.

The feed and melting of the crushed material continues until the accumulation in the vessel of the furnace of 30 t of the molten metal, and afterwards, 16-18 t of the metal from the furnace overflows once again.

When changing to another chemical composition, the molten metal remaining in the vessel after the overflow under the influence of the running magnetic field (h=150-200 mm—"liquid heel") is discharged through the tap-hole of full discharge.

The invention claimed is:

1. An apparatus for induction stirring of molten metal, the apparatus comprising a module comprising:

an inductor of a running magnetic field having a frequency of 50 to 60 Hz, the inductor having a shape of a flat rectangular box;

a channel made of a material that is resistant against molten metal;

a frame with a unit placed therein;

a chamber along the longitudinal axis of the unit;

a flange and components for fastening the module to a side wall of a furnace;

wherein the inductor is placed horizontally under the bottom of the chamber, the longitudinal axis of the chamber and the axle of the inductor are located in one vertical plane, a length of the chamber along the longitudinal axis of the chamber is confined by an end wall of the unit, and the frame has weight capturing devices;

wherein the apparatus further comprises a unit-adaptor in a wall of the chamber, the unit-adaptor having a window, wherein the dimensions and profile of the window from the outside of the wall are identical with a window of the chamber at an end of the unit, the bottom of the window in the unit-adaptor is realized edgewise the chamber with the inclination to the side of the bottom of the vessel of the furnace, and the window at the bottom of the chamber expands to the side of the vessel of the furnace.

2. The apparatus according to claim 1, wherein the channel is located in the end wall of the chamber, and a tube for purging molten metal with a gas-flux mixture is attached to the channel.

3. The apparatus according to claim 1, wherein the chamber has a lid.

4. The apparatus according to claim 1, wherein the channel is located in the end wall of the chamber and is in the form of a flat trench, a chute is attached to the upper part of the channel, and the trench has a height of 1 to 2 times d, where d is the depth of the penetration of the magnetic field into the molten metal.

5. The apparatus according to claim 1, wherein a pipe-siphon is attached to the channel.

6. The apparatus according to claim 3, wherein the channel is located in the end wall of the chamber and is in the form of a flat trench, a chute is attached to the upper part of the channel, and the trench has a height of 1 to 2 times d, where d is the depth of the penetration of the magnetic field into the molten metal.

7. The apparatus according to claim 4, wherein a pipe-siphon is attached to the channel.

8. The apparatus according to claim 1, wherein the bottom of the chamber is located 0.1H to 0.5H from the bottom of the vessel of the furnace, where H is the depth of the vessel of the furnace.

* * * * *